US006671985B2

(12) United States Patent
Bouleau

(10) Patent No.: US 6,671,985 B2
(45) Date of Patent: Jan. 6, 2004

(54) IRON COMPRISING A PUMP FOR WATER/ TEXTILE ADDITIVE MIXTURE

(75) Inventor: Jean-Paul Bouleau, Champfleur (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 10/181,472

(22) PCT Filed: Jan. 15, 2001

(86) PCT No.: PCT/FR01/00112

§ 371 (c)(1),
(2), (4) Date: Jul. 18, 2002

(87) PCT Pub. No.: WO01/53595

PCT Pub. Date: Jul. 26, 2001

(65) Prior Publication Data

US 2003/0056406 A1 Mar. 27, 2003

(30) Foreign Application Priority Data

Jan. 20, 2000 (FR) ..... 00 00874

(51) Int. Cl.[7] ..... D06F 75/22
(52) U.S. Cl. ..... 38/77.3; 38/77.5
(58) Field of Search ..... 38/77.1, 77.5, 38/77.6, 77.3, 77.82; 210/263, 282; 239/61, 407

(56) References Cited

U.S. PATENT DOCUMENTS

| | | | | | |
|---|---|---|---|---|---|
| 2,080,175 | A | * | 5/1937 | Kuno | 38/77.3 |
| 2,817,169 | A | * | 12/1957 | Schott | 38/77.1 |
| 4,459,771 | A | * | 7/1984 | Ogata | 38/77.8 |
| 4,578,884 | A | * | 4/1986 | Nakao | 38/77.3 |
| 5,398,434 | A | * | 3/1995 | Biancalani | 38/77.3 |
| 6,009,645 | A | * | 1/2000 | Shimizu et al. | 38/77.5 |

* cited by examiner

*Primary Examiner*—Ismael Izaguirre
(74) *Attorney, Agent, or Firm*—Browdy and Neimark, P.L.L.C.

(57) ABSTRACT

The invention concerns an iron comprising a water reservoir (5), a textile additive reservoir (12), and a pump (15) comprising a mixing chamber (20) capable of sucking into the mixing chamber a dose of water and a dose of additive via an additive proportioning tap (34), so as to produce in the mixing chamber a diluted additive solution, and of conveying said solution towards a sprayer (16). The invention is characterized in that the pump (15) is of the piston type mobile in a body (18) and defining the mixing chamber (20) which emerges into the water reservoir (5) via a non-return valve, and said pump (15) also serves as additive proportioning tap (34).

9 Claims, 6 Drawing Sheets

IRON COMPRISING A PUMP FOR WATER/ TEXTILE ADDITIVE MIXTURE

The present invention concerns an iron, notably a steam iron, having a water reservoir, a reservoir containing a textile additive, and a pump comprising a mixing chamber and capable, on the one hand, of aspirating into the mixing chamber a dose of water from the water reservoir as well as of additive from the additive reservoir via a tap permitting dosing of the additive, in a manner to produce in the mixing chamber a diluted solution of the additive, and on the other hand, of conveying this solution toward a spraying device situated in the forward part of the iron.

It is known that with such an iron, the spraying onto fabric of a diluted active product serves to facilitate ironing while improving sliding and removing creases.

In a known iron of this type, the water reservoir is connected to the aspiration pump by a capillary tube, while the tap permitting dosing of the additive is equally connected to the pump by another capillary tube. Such an arrangement of these various organs is particularly disparate and bulky and is difficult to produce during manufacture of the iron, The invention has particularly for its object to eliminate these inconveniences and to produce an iron, of the type set forth hereabove, in which the organs for pumping and dosing the additive are grouped together, this in view of simplifying their installation in the iron.

In an iron according to the invention the pump is of the piston type being displaced in a body and delimiting in the lower part of the body the mixing chamber that opens into the water reservoir via a one-way valve, and this pump equally serves as an additive dosing tap.

The pump and the additive dosing tap are thus grouped into a compact unitary body. In addition, the pump itself advantageously fulfills a double function, which is that of pumping to aspirate water and additive, and that of dosing of the additive intended to be mixed with the aspirated water, thus constituting in itself a true dosing pump of a mixture of water and textile additive. Such a dosing pump can be produced in the form of a small pump, thus occupying a small volume in the iron.

According to one manner of construction of the invention, the piston comprises two spaced mobile opening-closing organs, respectively called upper and lower, mounted in the body of the pump in delimiting between them a dosing chamber, and controlled respectively by first and second actuation means linked to the piston, said upper and lower organs being mobile between a rest position in which the upper organ is open, while the lower organ is closed, in a manner to permit the passage of a dose of additive from the additive reservoir toward the dosing chamber, and a working position in which the upper organ is closed under the action of the first actuation means, while the lower organ is opened under the action of the second actuation means, in a manner to permit passage of the dose of additive from the dosing chamber toward the mixing chamber.

The two mobile opening-closing organs, delimiting between them the dosing chamber, thus together play the role of a tap integrated into the pump itself and adapted to dose the additive intended to be mixed with the water aspirated by the pump.

According to another characteristic of the invention, the additive reservoir forms an integral part of the pump. Thus, the dosing pump and the additive reservoir advantageously constitute a unitary body that is particularly compact.

The characteristics and advantages of the invention will appear more clearly from the description that will follow, by way of non-limiting example, with reference to the attached drawings in which.

Figure 1:
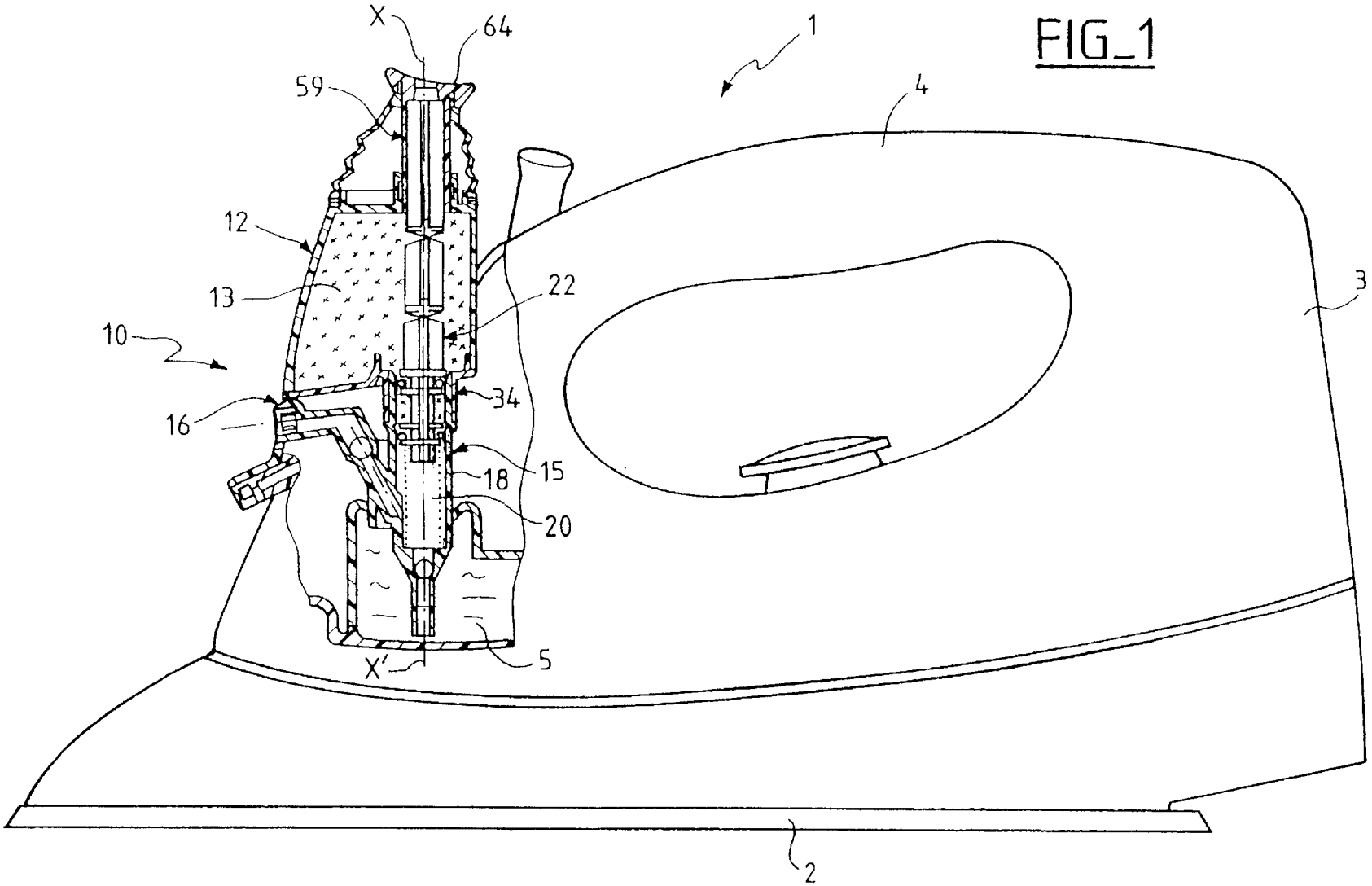
FIG. 1 is a schematic view in partial cross section with parts broken away of an iron according to the invention.

The iron 1 shown schematically in FIG. 1 comprises essentially an ironing sole plate 2, a cover 3 and a handle 4 atop the cover. At the interior of cover 3 are housed all of the conventional organs of an iron. Under cover 3 is housed in particular a reservoir 5 containing water without additive.

As is shown in FIG. 1, the iron is equipped in addition with a unitary body, designated by the general reference numeral 10, which is formed by a reservoir 12 containing a textile additive 13, a single manual aspiration pump 15 and a spraying device 16, of a structure that is known per se, situated in the forward region of the iron.

The textile additive 13 contained in reservoir 12 is, preferably, a concentrated active product of the type known as an ironing aid, composed notably of starch, water and a preservation product, and capable of being mixed with all types of water.

Pump 15 comprises a cylindrical tubular body 18, having a vertical axis of symmetry XX', produced by molding of a plastic material and having a mixing chamber 20. Pump 15 is adapted, on the one hand, to aspirate into this chamber 20 a dose of water from water reservoir 5 as well as a predetermined dose of additive from reservoir 12, in a manner to produce in mixing chamber 20 a diluted solution of the additive, and on the other hand, to convey this solution toward spraying device 16. The diluted additive solution, after spraying onto the fabric being ironed, serves in an advantageous manner to facilitate ironing in improving sliding and eliminating creases.

As is better shown in FIGS. 2, 7, 8 and 9, pump 15 is of the type having a piston 22 movable vertically in body 18 of the pump by being coupled to a return spring 23 that is axially disposed. Piston 22 delimits in the lower part of body 18 the mixing chamber 20 which opens into water reservoir 5 via a one-way valve here constituted by a ball 25 cooperating with a conical seat 26.

In this example of construction, see FIGS. 2, 7, 8 and 9, additive reservoir 12 forms an integral part of pump 15 and is mounted in a fixed manner and in a sealed manner, for example by mirror welding, on the upper part of body 18 of the pump while being traversed by piston 22; additive reservoir 12 presents an upper wall 27 traversed by piston 22 and a bottom wall 28 that opens directly into the upper part of body 18 of pump 15.

In this example, spraying device 16 itself also forms an integral part of pump 15 and, preferably results from molding with body 18 of the pump; this spraying device 16 comprises an inlet conduit 30 that opens into mixing chamber 20 of pump 15 via a one-way valve here constituted by a ball 31 cooperating with a conical seat 32.

According to the invention, pump 15 also serves as a tap, designated by the general reference numeral 34, permitting dosing of additive intended to be mixed with water from reservoir 5, in order to produce a mixture of water and additive proportioned in a predetermined dilution ratio.

Thus, pump 15 serves not only to aspirate water and additive, but also to dose the additive intended to be mixed with the water, thus constituting in itself a true dosing pump of a mixture of water and additive, capable moreover of being fabricated in the form of a small, compact pump.

By way of example, the additive being a concentrated product, pump 15 assures mixing of the concentrated product with water in a selected dilution ratio of around ⅛. In this example, concentrated product reservoir 12 has a capacity of 20 $cm^3$, while water reservoir 5 has a capacity of the order of 300 $cm^3$.

Figure 2:
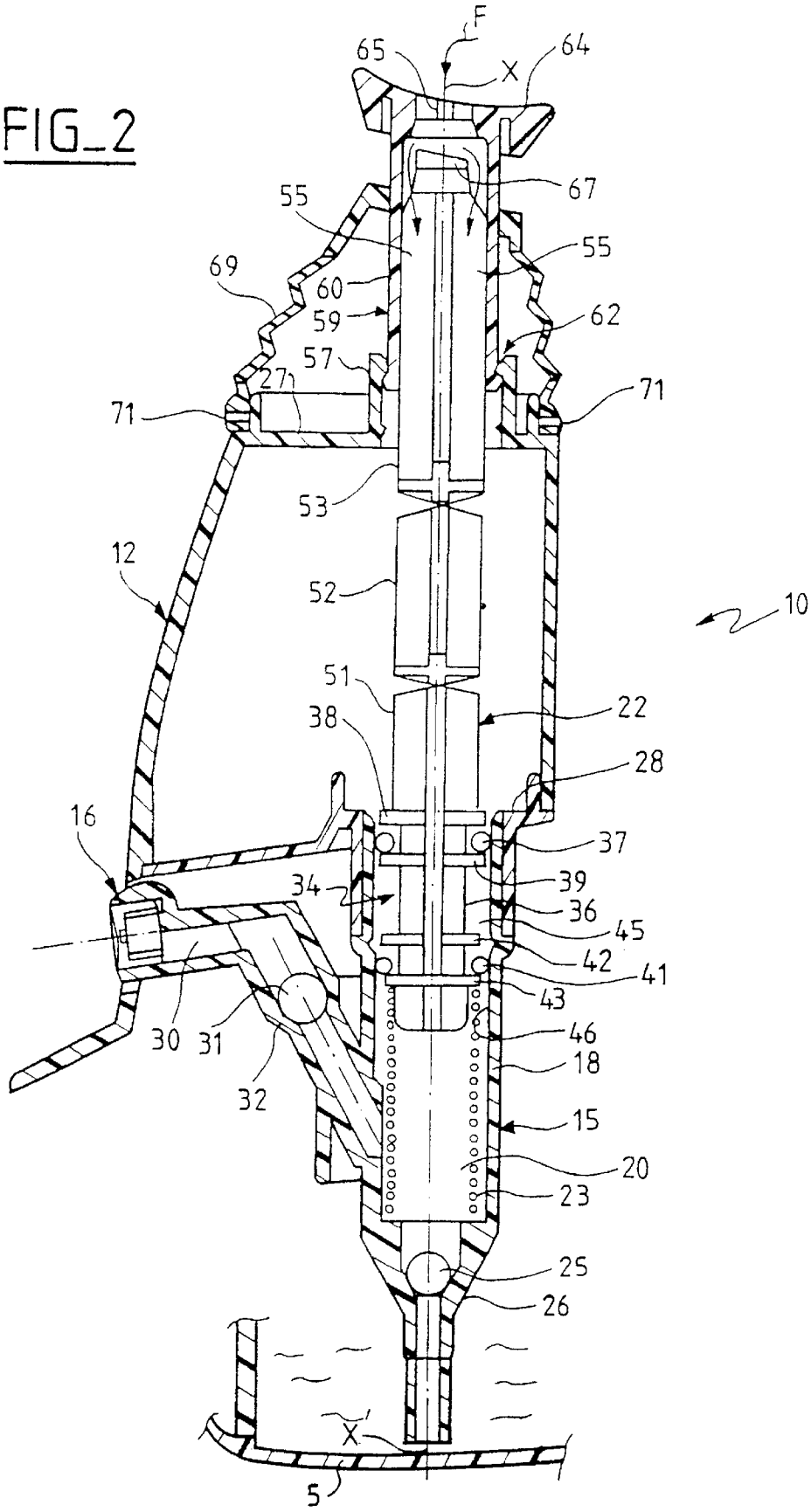
FIG. 2 is a partial view, to a larger scale and in cross section, of a water reservoir and a body formed by a dosing pump, an additive reservoir and a spraying device, before filling of the additive reservoir.
Figure 3:
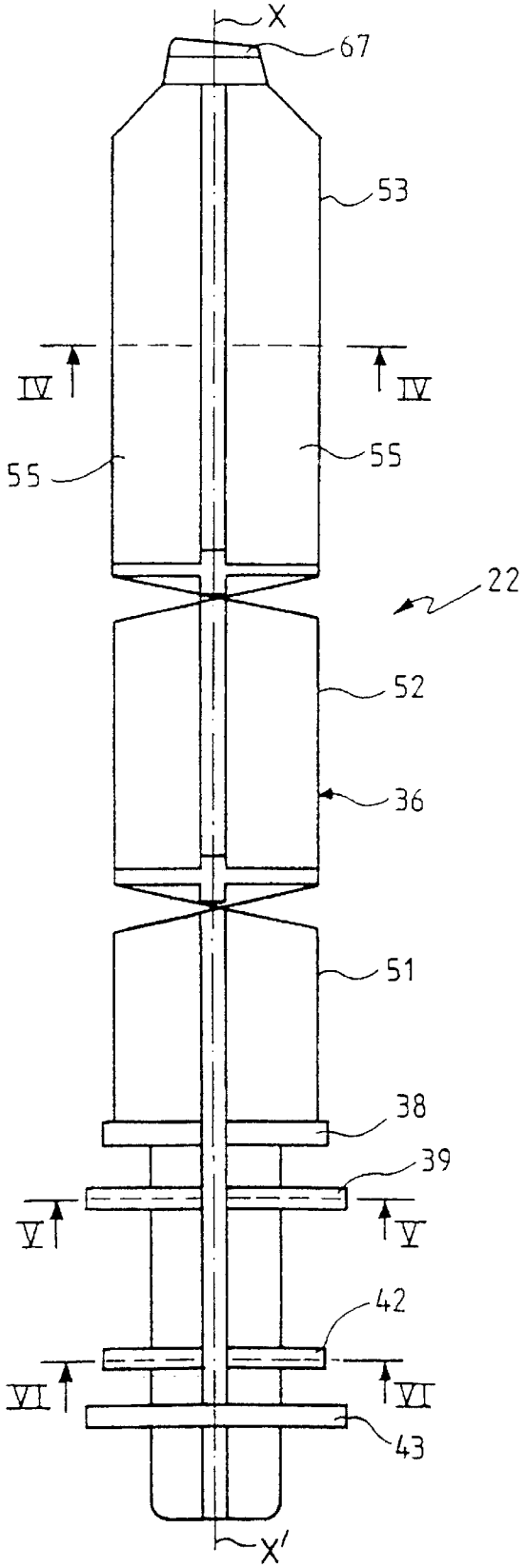
FIG. 3, is an elevational view, to a larger scale, of the piston of the pump of FIG. 2.

According to an embodiment illustrated in FIGS. 2, 7, 8 and 9, piston 22 is constituted by a rod 36 molded from a plastic material, more clearly visible in FIG. 3, and comprising two spaced mobile opening-closing organs constituted here respectively by two annular sealing joints, called upper 37 and lower 41, which are movably mounted in body 18 of the pump while being traversed by rod 36 and while delimiting between them a dosing chamber 45. These two annular joints 37 and 41 each have an external periphery which bears closely against the internal lateral face 46 of body 18 of the pump, thus forming a permanent seal on the inner surface of the body of the pump, and an internal periphery which is spaced at a radial distance from rod 36.

The two movable joints 37 and 41 are intended to be controlled respectively by first and second actuation means each here having two discs, called upper (38; 42) and lower (39; 43), which are carried in a transversely fixed manner by rod 36 while resulting advantageously from molding with the latter, and which are associated in pairs respectively with the two joints (37; 41) while being disposed to one side and the other of each joint. Each of these four discs (38, 39, 42, 43) has a diameter that is slightly smaller than the internal diameter of body 18 of pump 15.

Figure 5:
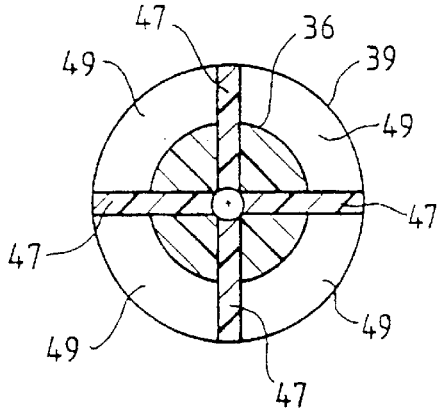
FIG. 5 is a cross-sectional view along the line V—V of FIG. 3.
Figure 6:
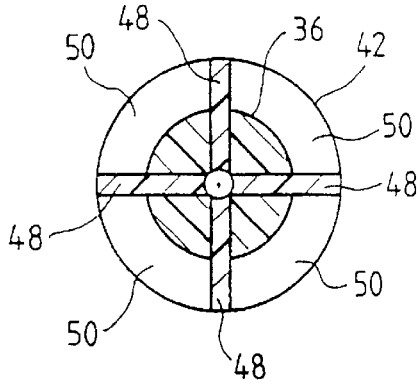
FIG. 6 is a cross-sectional view along the line VI—VI of FIG. 3.

The two discs, respectively upper 38 and lower 43, associated respectively with the upper 37 and lower 41 joints are constituted by solid discs, while the other two similar discs, that is the lower 39 and upper 42 discs, associated respectively with the upper 37 and lower 41 joints have openings. By way of example, with regard to FIGS. 5 and 6, the two discs 39 and 42 having openings, one of which (39) has a diameter slightly greater than the other disc 42, are each constituted by two orthogonal pairs of diametrically opposed ribs, referenced at 47 in FIG. 5 and at 48 in FIG. 6, thus defining between them openings (49, FIG. 5; 50, FIG. 6) intended for the passage of additive.

The two joints 37 and 41 in association with their two respective discs (38, 39; 42, 43), thus form valves that are moveable in vertical translation between:

a rest position (FIG. 7) in which upper joint 37 is open while bearing on associated open disc 39 and spaced from the associated solid disc 38, while lower joint 41 is closed by bearing in a sealed manner on associated solid disc 43 and spaced from associated open disc 42, in a manner to permit passage of a dose of additive from additive reservoir 12 toward dosing chamber 45 of pump 15 via openings 49 (FIG. 5) of disc 39;

and a working position (FIG. 8) in which upper joint 37 is closed by bearing in a sealed manner on associated solid disc 38, while lower joint 41 is opened by bearing on associated open disc 42, in a manner to permit passage of the dose of additive from dosing chamber 45 toward mixing chamber 20 of pump 15 via openings 50 (FIG. 6) of disc 42.

Figure 4:
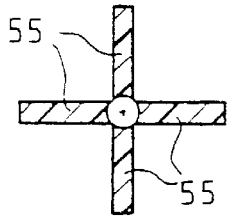
FIG. 4 is a cross-sectional view along the line IV—IV of FIG. 3.

As shown in FIG. 3, rod 36 of piston 22 comprises a plurality of sections connected together, in the present case numbering three referenced by 51, 52 and 53 on this FIG. 3, which have different lengths and which have an identical cross-sectional form here constituted by two orthogonal pairs of diametrically opposed radial ribs, referenced at 55 on FIG. 4 for upper section 53 of the rod.

Figure 7:
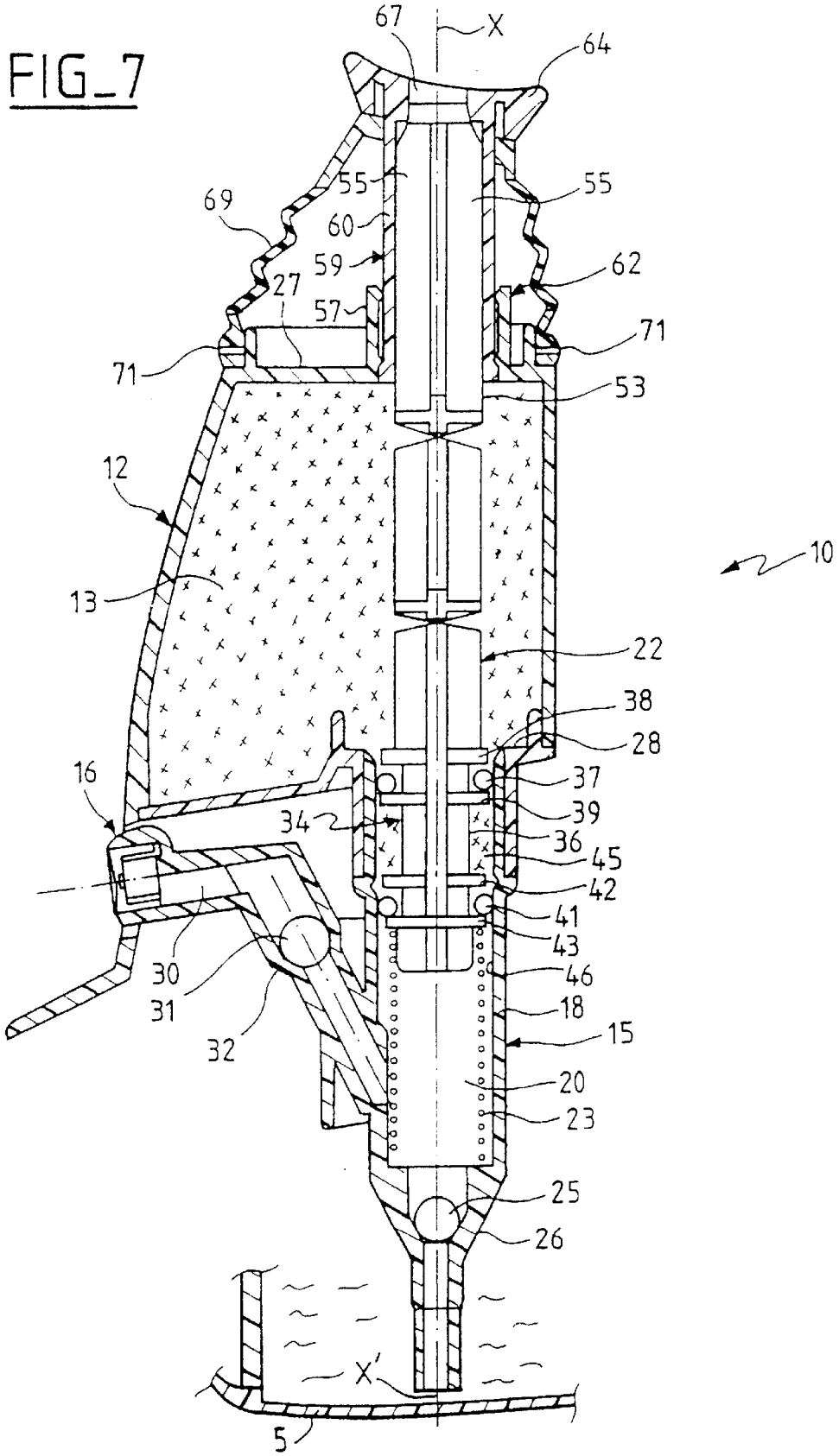
FIG. 7 is a view similar to FIG. 2, after filling and closing of the additive reservoir, the pump being shown in a primed position.

With respect to FIGS. 2 and 7, the upper wall 27 of additive reservoir 12 is topped by an open neck 57 that is traversed by ribs 55 forming upper section 53 of rod 36, and in which is mounted a plug 59 here comprising a cylindrical stem 60, oriented vertically on axis XX' while bearing against the free edges of ribs 55, cooperating with neck 57 by means of non-disconnectable fixation organs 62, of a structure known per se, and terminating at its upper part by a head 64 pierced by a central opening 65 situated above and in line with the upper extremity 67 of rod 36.

Plug 59 is displaceable, for example in vertical translation, between an upper position (FIG. 2) in which opening 65 of head 64 of the plug is disengaged from upper extremity 67 of rod 36 and constitutes an opening for replenishing additive, and a lower position (FIG. 7) in which the opening of head 64 of the plug is blocked by upper extremity 67 of rod 36 after filling additive reservoir 12.

Thus, filling of additive reservoir 12 is effectuated in a manner that is easy for the user. This latter slightly lifts plug 39 to disengage opening 65, as illustrated in FIG. 2, then introduces into this latter, along arrow F of FIG. 2, additive contained, for example, in a bottle having the same capacity as reservoir 12. The additive flows into reservoir 12 by passage between ribs 55 forming upper section 53 of rod 36.

During filling of additive reservoir 12, a dose of additive penetrates into dosing chamber 45 of pump 15 due to the opening of the upper joint 37 forming a valve and the sealed closing of lower joint 41 forming a valve, as is clearly visible in FIG. 7.

After filling of additive reservoir 12, the user pushes plug 59 back in order to close opening 65 in which upper extremity 67 of rod 36 fits perfectly, as illustrated in FIG. 7.

It is in order to note that the fact of rendering plug 59 of additive reservoir 12 impossible to lose is particularly pleasing to the user.

In an advantageous manner, head 64 of plug 59, after filling and closing of additive reservoir 12 (FIG. 7), constitutes in itself a manual control push button for rod 36 forming a piston, thus permitting achievement in a single part the organs for additive filling and for manual control of the piston of dosing pump 15.

There is shown at 69 in FIGS. 2, 7, 8 and 9 a flexible bellows that is interposed between the upper wall of additive reservoir 12, around neck 57 of the latter, and head 64 of plug 59. At the base of bellows 69 there is provided a peripheral vent 71 intended to permit folding and unfolding of the bellows.

The unitary body 10 formed by additive reservoir 12, dosing pump 15 and spraying device 16 constitutes a compact body that is removably mounted in cover 3 of the iron.

In the example of construction shown in FIG. 1, this removable unitary body 10 is installed in the front part of the iron, and the push button of dosing pump 15, constituted by head 64 of plug 59, is positioned with respect to handle 4 at a height such that the user can maneuver pump 15 practically without having to reposition his hand on the handle of the iron.

In this example, FIG. 1, additive reservoir 12 projects almost entirely from the front part of the iron and is transparent, thus rendering the level of additive visible.

In order to use the iron, after filling and closing of additive reservoir 12 (FIG. 7), the user presses on head 64 of plug 59, which has for its effect to fold bellows 69, in a manner to cause descent of rod 36 forming a piston in opposition to spring 23. During the course of this descent, upper joint 37 forming a valve is closed, while lower joint 41 forming a valve is open, thus permitting the dose of additive contained in dosing chamber 45 to pass into mixing chamber 20 of the pump. Then, the user releases head 64 of plug 59, so that the rod 36 forming a piston returns upwardly under the effect of spring 23, while bellows 69 unfolds. During the course of this raising movement of rod 36, valve 25 opens and a dose of water from reservoir 5 is aspirated into mixing chamber 20 in which water and additive mix in order to produce a solution of additive diluted in the chosen dilution ratio. At the end of upward movement of rod 36, lower joint 41 forming a valve closes, while upper joint 37 forming a valve opens, thus permitting a new dose of additive to penetrate into dosing chamber 45 of the pump. Pump 15 is thus primed, as illustrated in FIG. 7.

Figure 8:
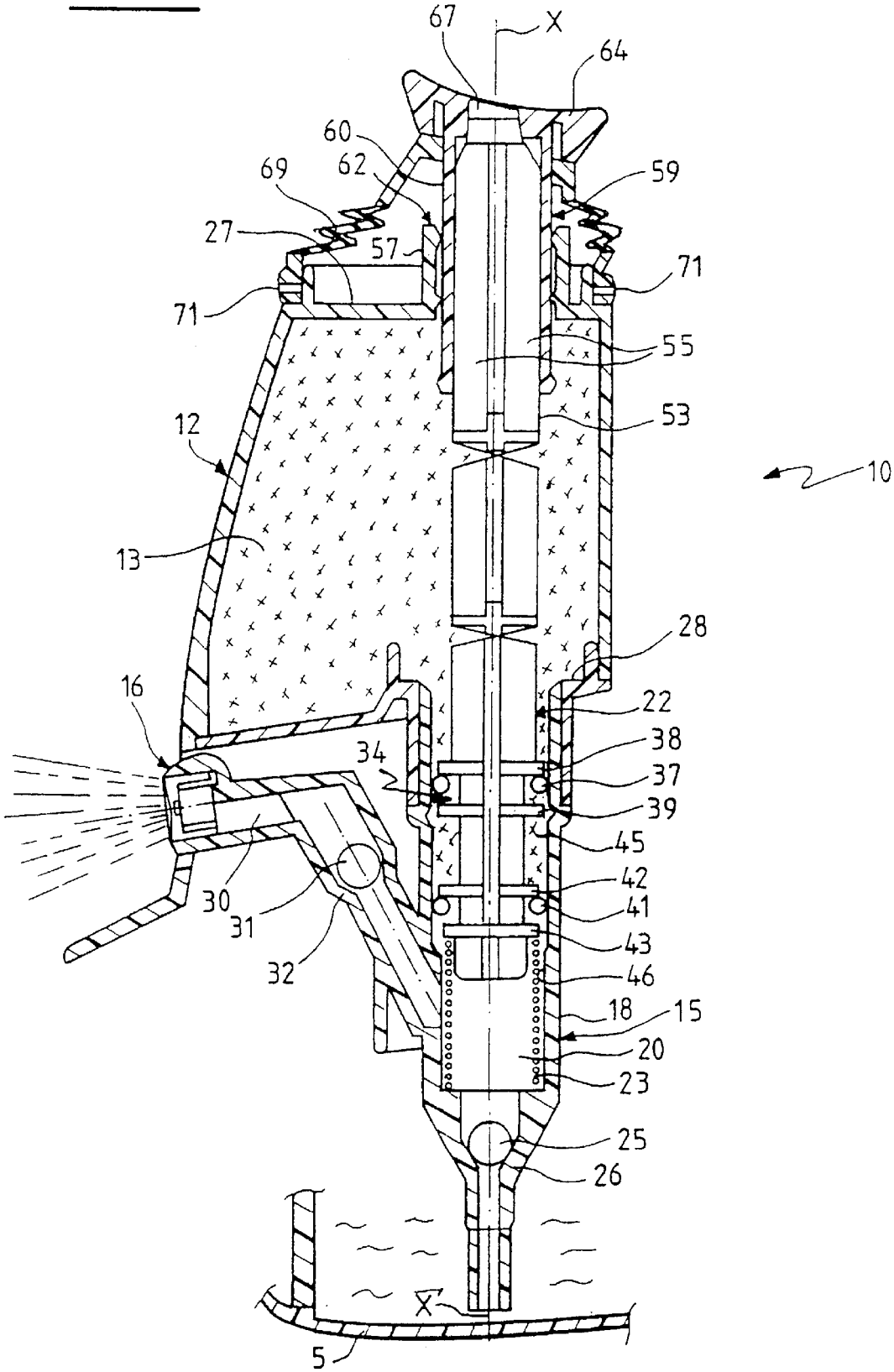
FIG. 8 is a view similar to FIG. 7 showing the pump during use of the iron in its spraying function.

After priming of pump 15, the user presses on head 64 of plug 59. Under the effect of the descent of rod 36 forming a piston, the diluted additive solution present in mixing chamber 20 is then forced back and sent toward spraying device 16 via conduit 30 following opening of valve 31 under the effect of the pressure of the forced back solution. One then obtains, by spraying device 16, an ejection of diluted additive solution, as illustrated in FIG. 8.

Figure 9:
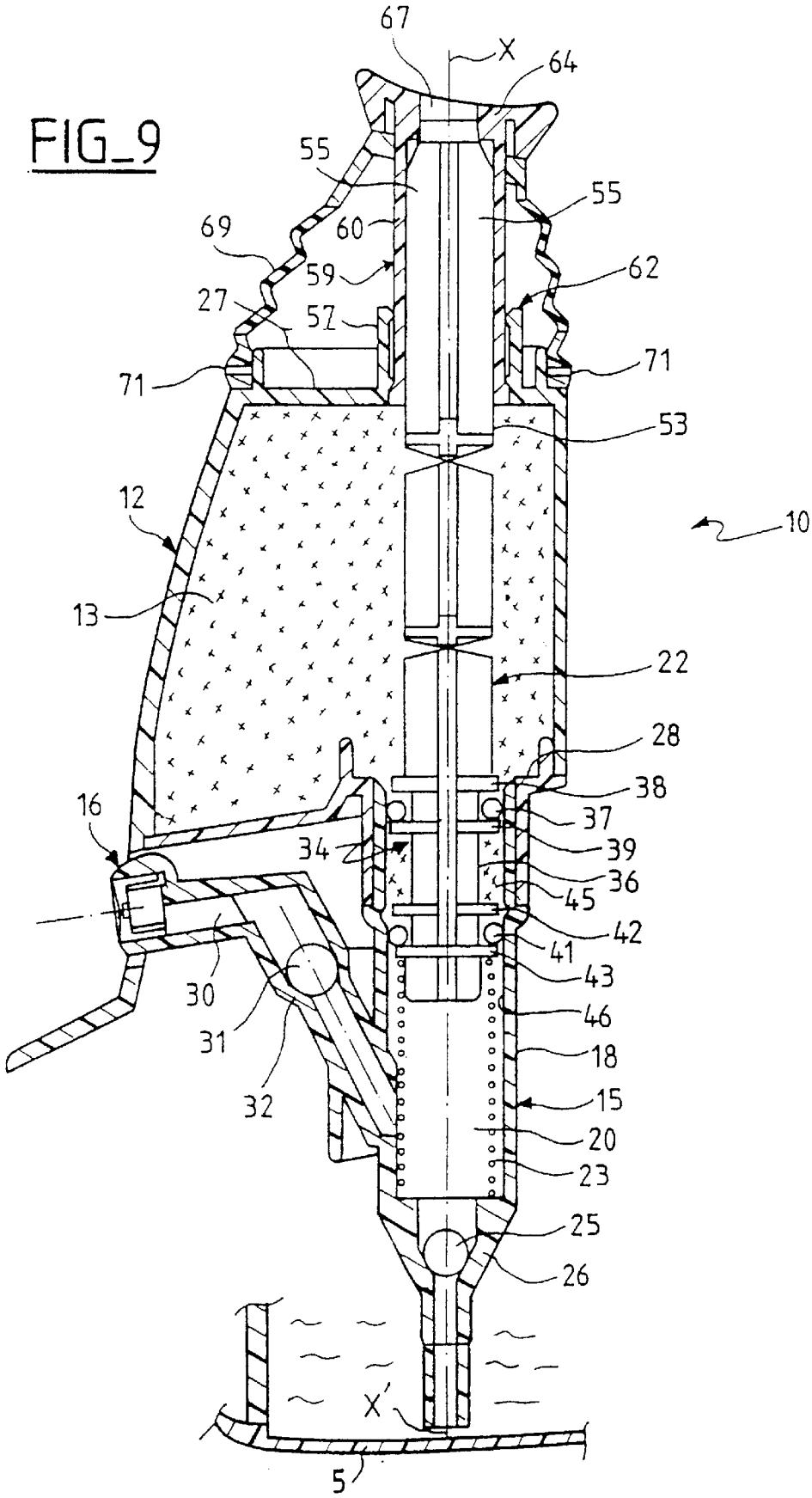
FIG. 9 is a view similar to FIG. 8, the pump being reprimed.

When the user releases head 64 of plug 59, pump 15, under the effect of spring 23, is reprimed as illustrated in FIG. 9.

What is claimed is:

1. An iron comprising:

a water reservoir (5);

an additive reservoir (12) containing a textile additive; and a pump (15) comprising a mixing chamber (20), said pump being operable for aspirating into the mixing chamber (20) a dose of water from the water reservoir (5) as well as of additive from the additive reservoir (12) via a tap (34) for permitting dosing of the additive, in a manner to produce in the mixing chamber (20) a diluted solution of the additive, and said pump being operable for delivering the diluted solution toward a spraying device (16) situated in a forward part of the iron, wherein the pump (15), the additive reservoir (12) and the spraying device (16) constitute a unitary body that is removably mounted in the iron (1).

2. The iron according to claim 1, wherein said unitary body is installed in a front part of the iron with said additive reservoir (12) projecting at least partially from the front part of the iron.

3. The iron according to claim 2, wherein said additive reservoir (12) is transparent.

4. The iron according to claim 1, wherein: said pump (15) comprises a tubular body (18) and a piston displaceable in said tubular body;

said mixing chamber (20) is delimited by a lower part of said tubular body;

said iron further comprises a one-way valve (25) interposed between said water reservoir (5) and said mixing chamber (20) for permitting water to flow from said water reservoir (5) to said mixing chamber (20); and said pump (15) further comprises means forming an additive dosing tap (34).

5. The iron according to claim 4, wherein:

said tubular body has a substantially vertical axis;

said additive reservoir (12) is mounted in a sealed manner on an upper part of said tubular body (18) while being traversed by said piston (22); and said additive reservoir has a bottom (28) that opens into said upper part of said tubular body (18).

6. The iron according to claim 5, wherein:

said piston has an upper section that traverses a neck (57) formed in said additive reservoir (12), said upper section being provided with radially extending ribs (55) having free edges and said upper section having an upper extremity;

said iron further comprises a plug (59) mounted in the neck (57) and bearing against the free edges of the ribs (55), and fixation organs (62) for preventing said plug from being removed from said iron;

said plug has an opening (65) situated above and in line with the upper extremity of the piston, and said plug is displaceable between an upper position in which said opening of said plug is disengaged from said upper extremity of said upper section and constitutes an opening for replenishing additive, by flow of the additive into said additive reservoir through said opening and between said ribs, and a lower position in which said opening is blocked by said upper extremity of said upper section; and said plug, when in the lower position, constitutes a manual control button for said piston.

7. The iron according to claim 6, wherein:

said piston (22) comprises upper and lower mobile opening-closing organs (37, 41) spaced apart from one another and mounted in said tubular body (18), said opening-closing organs delimiting between them a dosing chamber (45);

said iron further comprises first and second actuation means (38, 39; 42, 43) linked to said piston (22) for controlling said opening-closing organs;

said upper and lower opening-closing organs are movable between a rest position in which said upper organ (37) is open and said lower organ (41) is closed, in a manner to permit the passage of a dose of additive from said additive reservoir (12) toward said dosing chamber (45), and a working position in which said upper organ (37) is closed under the action of said first actuation means (38, 39) and said lower organ (41) is opened under the action of said second actuation means (42, 43), in a manner to permit passage of a dose of additive from said dosing chamber (45) toward said mixing chamber (20).

8. The iron according to claim 7, wherein:

said tubular body (18) is cylindrical and said piston (22) is constituted by a rod (36);

said upper and lower mobile opening-closing organs are constituted respectively by an upper annular sealing joint (37) and a lower annular sealing joint (41) traversed by said rod (36);

said tubular body has an internal lateral face (46) and each of said annular sealing joints has an external periphery that bears closely against said internal lateral face and an internal periphery that is spaced at a radial distance from said rod (36);

each of said first and second actuation means comprises an upper disc (38;42) and a lower disc (39;43) carried transversely by said rod (36);

each of said upper and lower discs has a diameter that is slightly smaller than the internal diameter of said tubular body (18) and said upper and lower discs are disposed in pairs to one side and the other of each of said sealing joints (37; 41); and said upper disc (38) that is associated with said upper sealing joint and said lower disc (43) that is associated with said lower sealing joint are solid, and said lower disc (39) that is associated with said upper sealing joint and said upper disc (42) that is associated with said lower sealing joint have openings, said upper sealing joint and said lower sealing joint bearing, in a rest position, respectively on associated lower discs (39; 43) while being spaced respectively from the associated upper discs (38; 42), and coming, in a working position, to bear respectively on the associated upper discs (38; 42).

9. The iron according to claim 1, wherein the textile additive is a concentrated product and mixture of the concentrated product with water is effected in a dilution ratio of around ⅛.

* * * * *